US007459039B1

(12) United States Patent
Watson

(10) Patent No.: US 7,459,039 B1
(45) Date of Patent: Dec. 2, 2008

(54) METHOD FOR FORMING CARBIDE BANDING IN STEEL MATERIALS USING DEFORMATION

(76) Inventor: Daniel Watson, 350 Jennifer La., Driftwood, TX (US) 78619

( * ) Notice: Subject to any disclaimer, the term of this patent is extended or adjusted under 35 U.S.C. 154(b) by 436 days.

(21) Appl. No.: 11/141,515

(22) Filed: May 31, 2005

Related U.S. Application Data

(60) Provisional application No. 60/582,359, filed on Jun. 23, 2004.

(51) Int. Cl.
*C21D 8/00* (2006.01)

(52) U.S. Cl. ..... 148/651; 148/652; 148/653; 148/654

(58) Field of Classification Search ..... 148/326, 148/328, 547–548, 607–618, 579, 648–654, 148/660–661, 624
See application file for complete search history.

(56) References Cited

U.S. PATENT DOCUMENTS

| | | | | |
|---|---|---|---|---|
| 4,448,613 | A | 5/1984 | Sherby et al. | |
| 4,769,214 | A | 9/1988 | Sherby et al. | |
| 5,445,685 | A | 8/1995 | Strum et al. | |
| 6,395,108 | B2 * | 5/2002 | Eberle et al. | 148/330 |

FOREIGN PATENT DOCUMENTS

| | | | |
|---|---|---|---|
| JP | 56133445 | * | 10/1981 |
| JP | 09-137247 | * | 5/1997 |
| JP | 2000-273537 | * | 10/2000 |

OTHER PUBLICATIONS

The computer-generated English translation of Japanese patent 2000-273537, Oct. 3, 2000, Suzki,Mashito et al.*
Computer-generated English translation of Japanese patent 09-137247, Anami, Goro et al. , May 27, 1997.*
Verhoeven, John D., A Review of Microsegregation Induced Banding Phenomena in Steels, Journal of Materials Engineering and Performance, vol. 9(3) Jun. 2000, pp. 286-296.
Sword Forum International, found at http://forums.swordforum.com/showthread.php?t=11162, as of Dec. 20, 2007.

* cited by examiner

*Primary Examiner*—Deborah Yee
(74) *Attorney, Agent, or Firm*—Buskop Law Group, PC; Wendy Buskop

(57) ABSTRACT

The method of making steel with carbide banding entails using steel with undissolved carbides distributed within the steel for forming steel with carbide banding, wherein the steel is about 0.3 weight percent to about 2.2 weight percent carbon and at least 0.003 weight percent of chromium, molybdenum, aluminum, vanadium, tungsten, or a similar carbide forming element; then, deforming the steel with undissolved carbides to create steel with carbide banding upon cooling, heating the steel with undissolved carbides for a specified time ranging at a specified temperature to form an austenitic steel with undissolved carbides, and cooling the austenitic steel with undissolved carbides to maintain the undissolved carbides within a crystalline matrix forming steel with carbide banding.

22 Claims, 6 Drawing Sheets

METHOD FOR FORMING CARBIDE BANDING IN STEEL MATERIALS USING DEFORMATION

CROSS REFERENCE TO RELATED APPLICATIONS

The present application claims priority to co-pending U.S. Provisional Patent Application Ser. No. 60/582,359 filed on Jun. 23, 2004.

FIELD

The present embodiments relate generally to methods of forming and manipulating carbide banding in steel using a processing method that involves deformation of the steel article.

BACKGROUND

A need exists for a process to treat metals and similar materials of manufacture in order to increase their structural characteristics. For example, in the manufacture of tools and tool components, machinery, engine parts, wear surfaces and like articles from various steels and materials that are used for high wear applications, the common practice is to subject the steel to one or more thermal process treatments, either before or after formation of the steel carbide, so as to modify the properties of at least the exterior of the components. These treatments provide the articles with greater strength, enhanced conductivity, greater toughness, enhanced flexibility, longer wear life, and the like.

A number of thermal type processes are known in the metallurgical arts to enhance the properties of manufacturing materials, such as steels and the like. One widely used class of such metallurgical processes generally known as quenching can involve forming an article of the desired metal containing material and then rapidly lowering the temperature of the article followed by a return of the article to ambient temperature. The problem with the current processes controlled or not, is the formation of residual stress in the material. This results in stressing the material and even possibly fracturing the material rendering it useless.

A further enhancement process for manufacturing materials, such as steel, is in the formation of a nitride containing layer on the surface of an article of the metal containing material that hardens the material by forming nitrides such as metal nitrides at or near the surface of an article. The formed nitride surface layer can include extremely hard compounds containing nitrides such as CrN, Fe2N, Fe3N and Fe4N. The formed nitride layer tends to create compressive stresses that improve the properties of the metal containing material, but can also lead to distortions in the article being treated.

The current art describes single wave processes that concentrate on the cryogenic target temperature and possibly one positive range temperature. The focus of the current art on the cryogenic target temperature does not give any regard to the material being treated. The cryogenic phase causes stress in the metal and the subsequent heat process also causes stress in the material. The prior art has done little to deal with these secondary stresses.

A need, therefore, exists, for multi-wave thermal treatments in which the target temperatures are dictated by the material being treated.

A need has long existed for a thermal process to treat a metal or article of manufacture to improve its structural characteristics.

The present embodiments meet these needs.

SUMMARY

The method of making steel with carbide banding entails using steel with or without undissolved carbides distributed within the steel for forming steel with carbide banding. The steel used is about 0.3 weight percent to about 2.2 weight percent carbon and at least 0.003 weight percent of chromium, molybdenum, aluminum, vanadium, tungsten, or a similar carbide forming element.

The method continues by deforming the steel with or without undissolved carbides to create steel with carbide banding upon cooling and heating the material for a specified time and a specified temperature. The present method details the specified times and specified temperatures used to form an austenitic steel with undissolved carbides. The method ends by cooling the austenitic steel with undissolved carbides to maintain the undissolved carbides within a crystalline matrix forming steel with carbide banding

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that it can be practiced or carried out in various ways.

The present method is directed to a method of making steel with carbide banding. The steel used in the method is composed of about 0.3 weight percent to about 2.2% weight carbon and at least 0.003% weight of a particular metal. Examples of particular metals contemplated in the methods are chromium, molybdenum, aluminum, vanadium, tungsten, or similar carbide forming elements.

Figure 1:
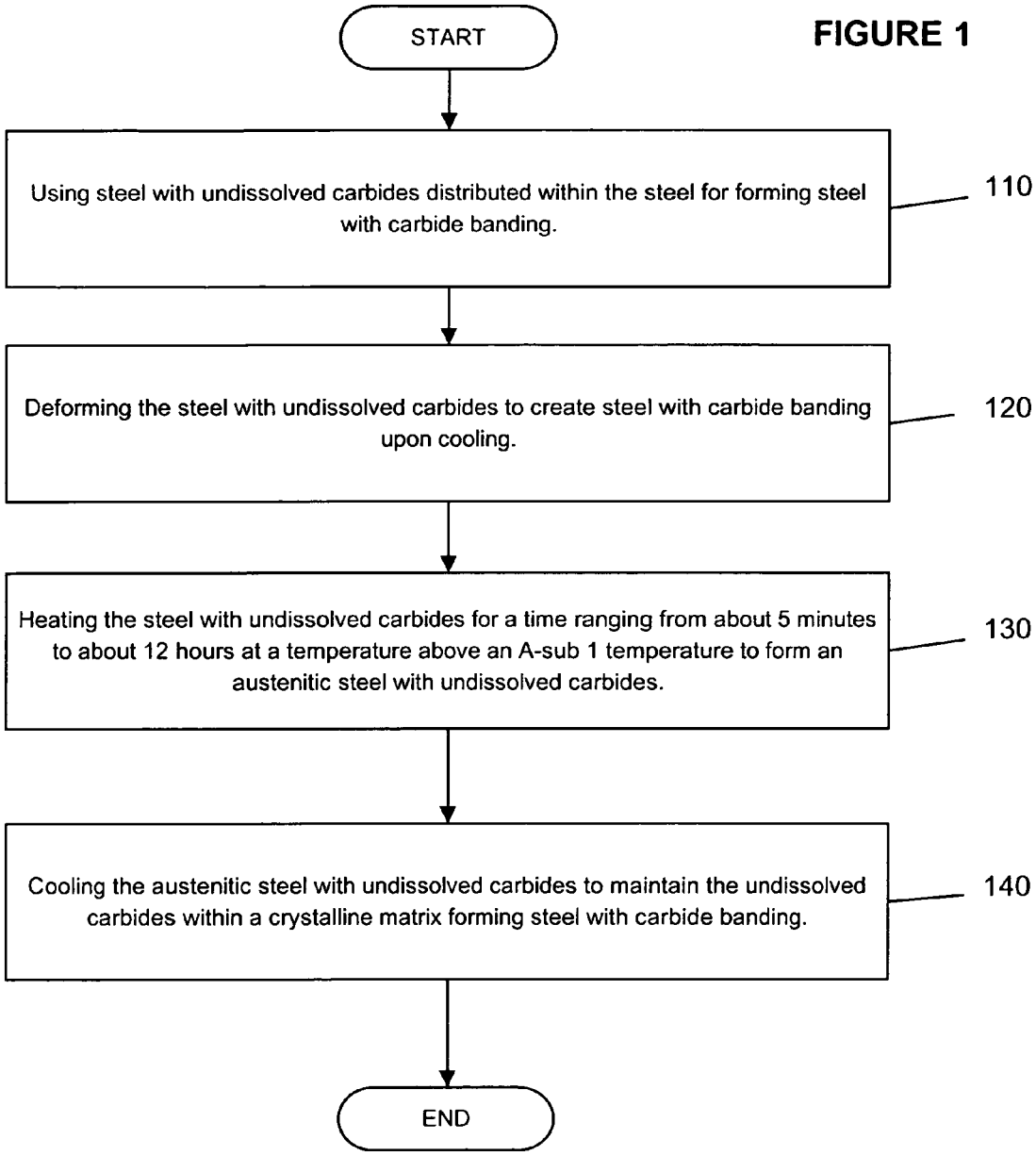
FIG. 1 is a schematic of the method of making steel with carbide banding.

With reference to the Figures, FIG. 1 shows a schematic directed to a method of making steel with carbide banding.

As shown in FIG. 1, the method begins by using steel with undissolved carbides distributed within the steel for forming steel with carbide banding (110) and deforming the steel with undissolved carbides to create steel with carbide banding upon cooling (120). The next step entails heating the steel with undissolved carbides for a time ranging from about 5 minutes to about 12 hours (130), in an alternative embodiment the range can be from about 20 minutes to about 40 minutes. The heating occurs at a temperature above an A-sub 1 temperature, for example at least 1330 degrees Fahrenheit. The method ends by cooling the austenitic steel with undissolved carbides to maintain the undissolved carbides within a crystalline matrix forming steel with carbide banding (140). The cooling step occurs at a time ranging from about 1 second to about 3 hours.

Figure 2:
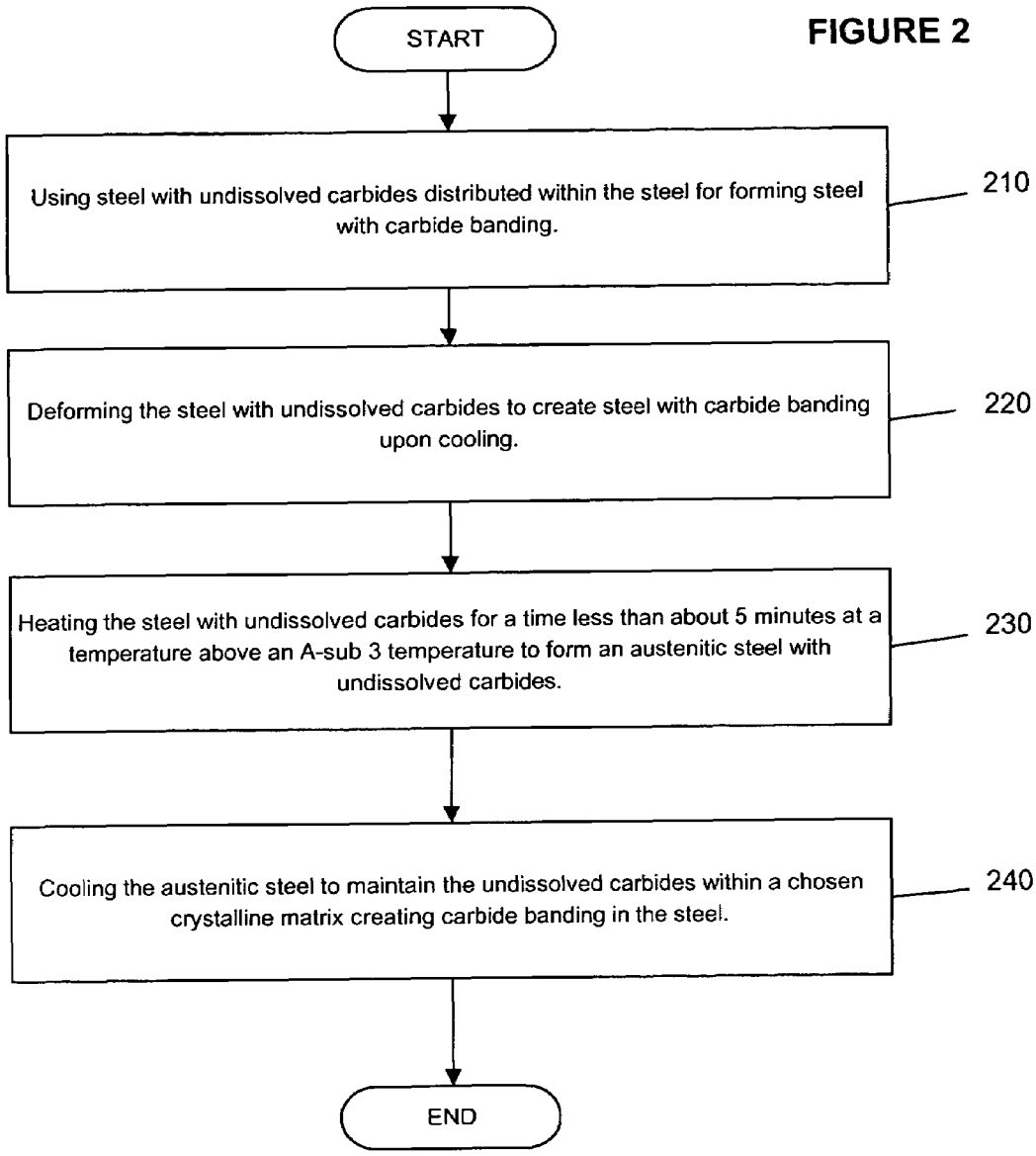
FIG. 2 is a schematic of an alternative embodiment of the method.

FIG. 2 depicts an alternative embodiment for a method of making steel with carbide banding. The method begins by using steel with undissolved carbides and then forming carbides in the steel by heating the steel with undissolved carbides (210). The method continues by deforming the steel with undissolved carbides to create steel with carbide banding upon cooling (220). The steel with undissolved carbides is heated for a time less than about 5 minutes at a temperature above an A-sub 3 temperature to form austenitic steel with undissolved carbides (230). The heating can be performed at the A-sub 3 temperature ranging from about 1375 degrees Fahrenheit to about 2100 degrees Fahrenheit. The method ends by cooling the austenitic steel to maintain the undissolved carbides within a chosen crystalline matrix creating carbide banding in the steel (240).

Figure 3:
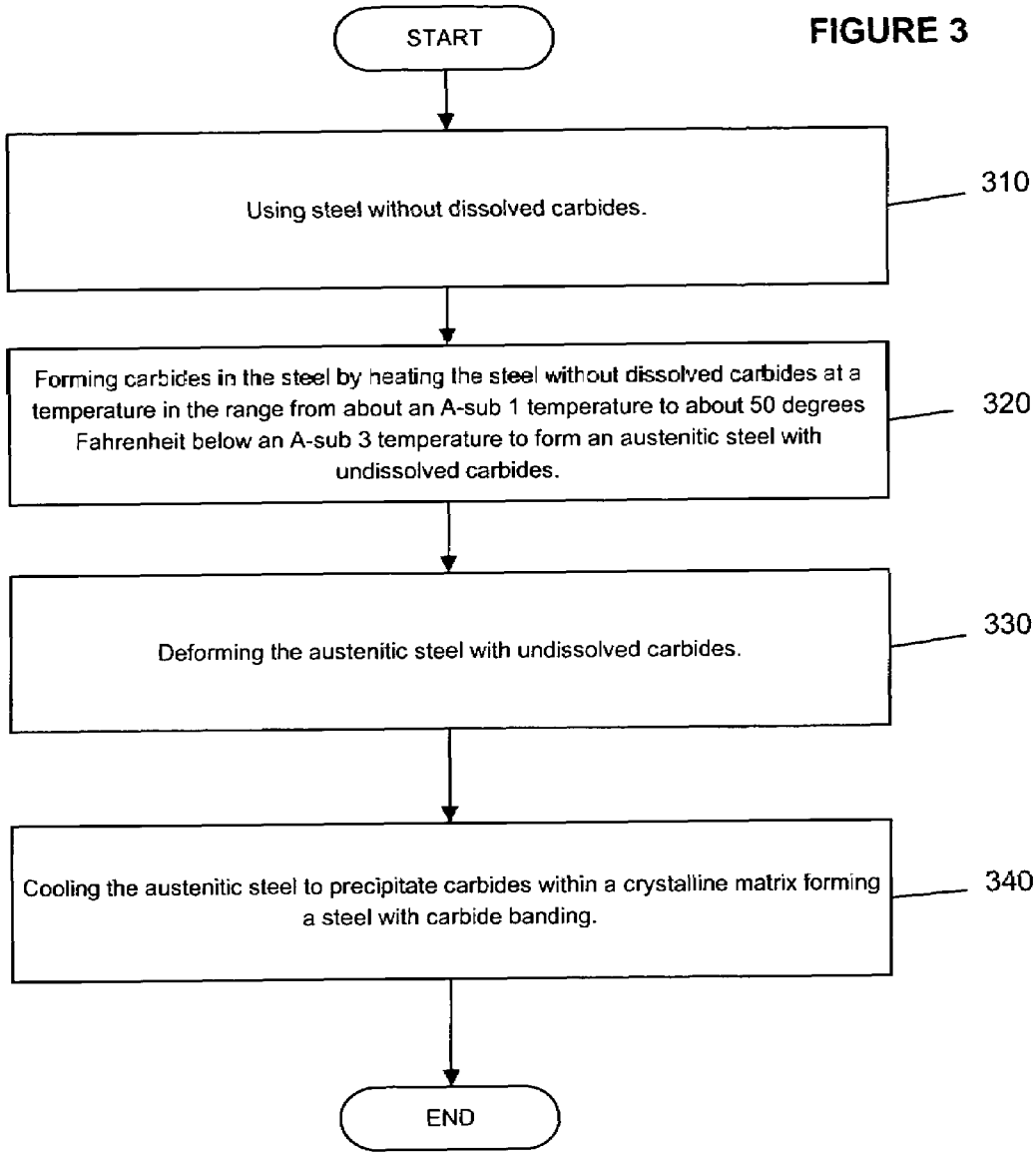
FIG. 3 is a schematic of an alternative embodiment of the method.

FIG. 3 depicts another alternative embodiment for a method of making steel with carbide banding. The method entails using steel without dissolved carbides (310). The carbides are formed in the steel by heating the steel without dissolved carbides at a temperature above an A-sub 1 temperature and 50 degrees Fahrenheit below an A-sub 3 temperature to form austenitic steel with undissolved carbides (320). The A-sub 3 temperature ranges from about 1375 degrees Fahrenheit to about 2100 degrees Fahrenheit and the A-sub 1 temperature is at least 1330 degrees Fahrenheit. The heating step takes place at a time ranging from about 20 minutes to about 40 minutes.

Continuing with FIG. 3, the austenitic steel is then subjected to a deformation process (330). The method ends by cooling the austenitic steel to precipitate carbides within a crystalline matrix forming steel with carbide banding (340), an example of the time range for cooling is from about 1 second to about 3 hours.

Figure 4:
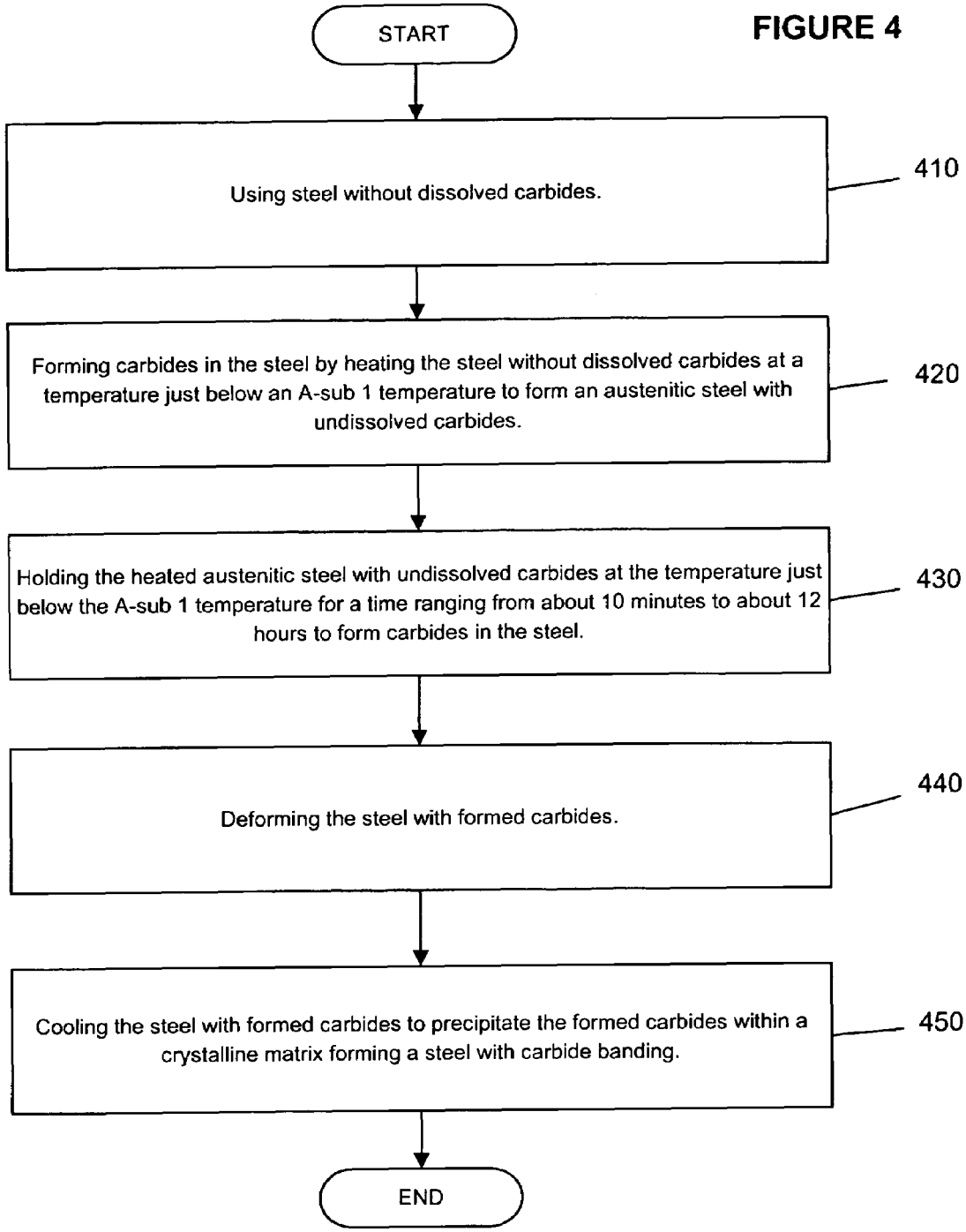
FIG. 4 is a schematic of an alternative embodiment of the method.

FIG. 4 depicts another alternative embodiment for a method of making steel with carbide banding. The method begins by using steel without dissolved carbides (410). The method continues by forming carbides in the steel by heating the steel without dissolved carbides at a temperature just below an A-sub 1 temperature to form austenitic steel with undissolved carbides (420). The heated austenitic steel with undissolved carbides is then held at a temperature just below the A-sub 1 temperature for a time ranging from about 10 minutes to about 12 hours to form carbides in the steel (430). The steel with formed carbides is then subjected to a deformation process (440). The method ends by cooling the steel with formed carbides to precipitate the formed carbides within a crystalline matrix forming a steel with carbide banding (450).

Figure 5:
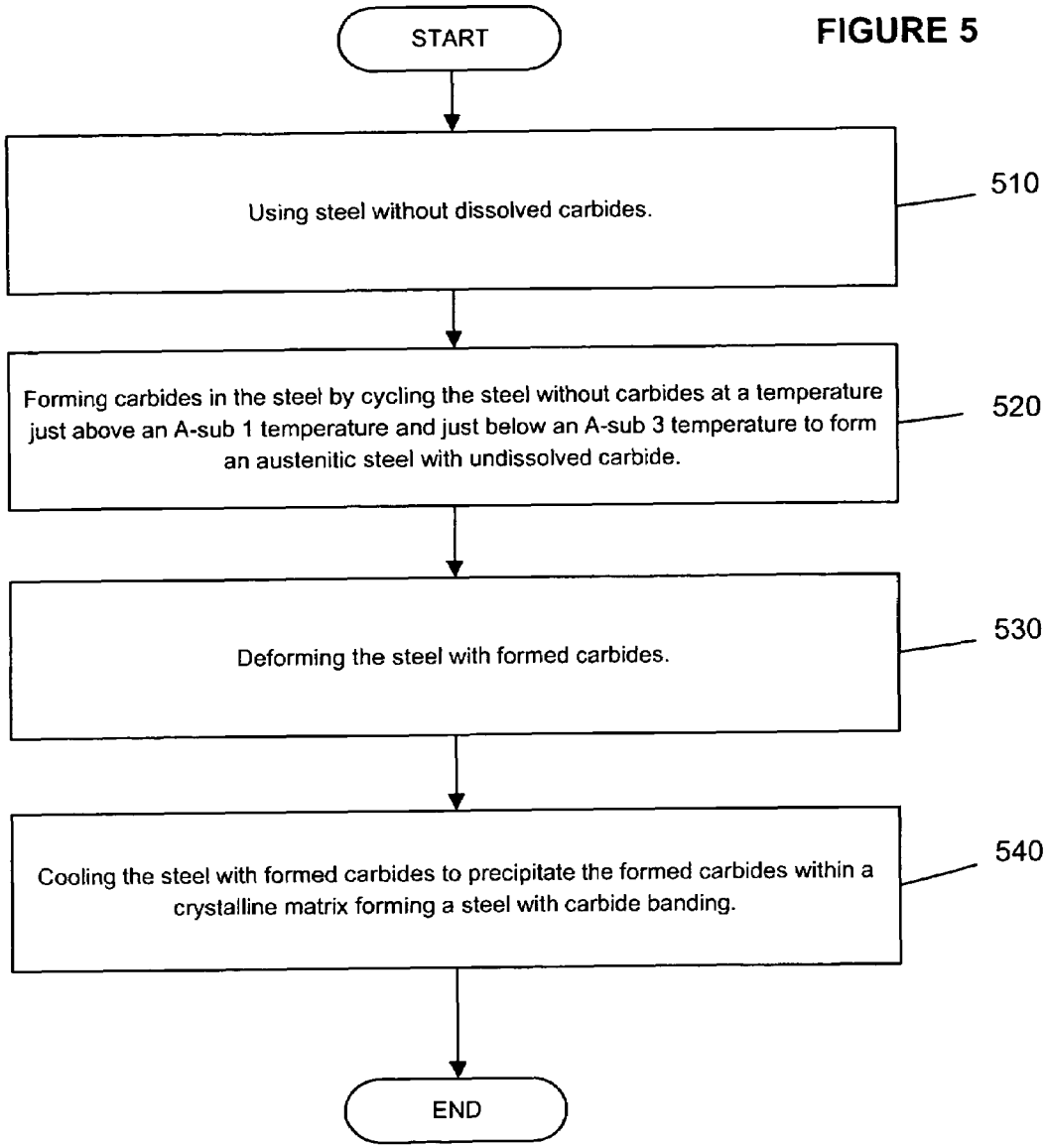
FIG. 5 is a schematic of an alternative embodiment of the method.

FIG. 5 depicts another alternative embodiment for a method of making steel with carbide banding. The method begins by using steel without dissolved carbides (510). Next, carbides in the steel are formed by cycling the steel without carbides at a temperature just above an A-sub 1 temperature and just below an A-sub 3 temperature to form austenitic steel with undissolved carbide (520). The steel with formed carbides is subjected to a deformation process (530). The method ends by cooling the steel with formed carbides to precipitate the formed carbides within a crystalline matrix forming steel with carbide banding (540).

Figure 6:
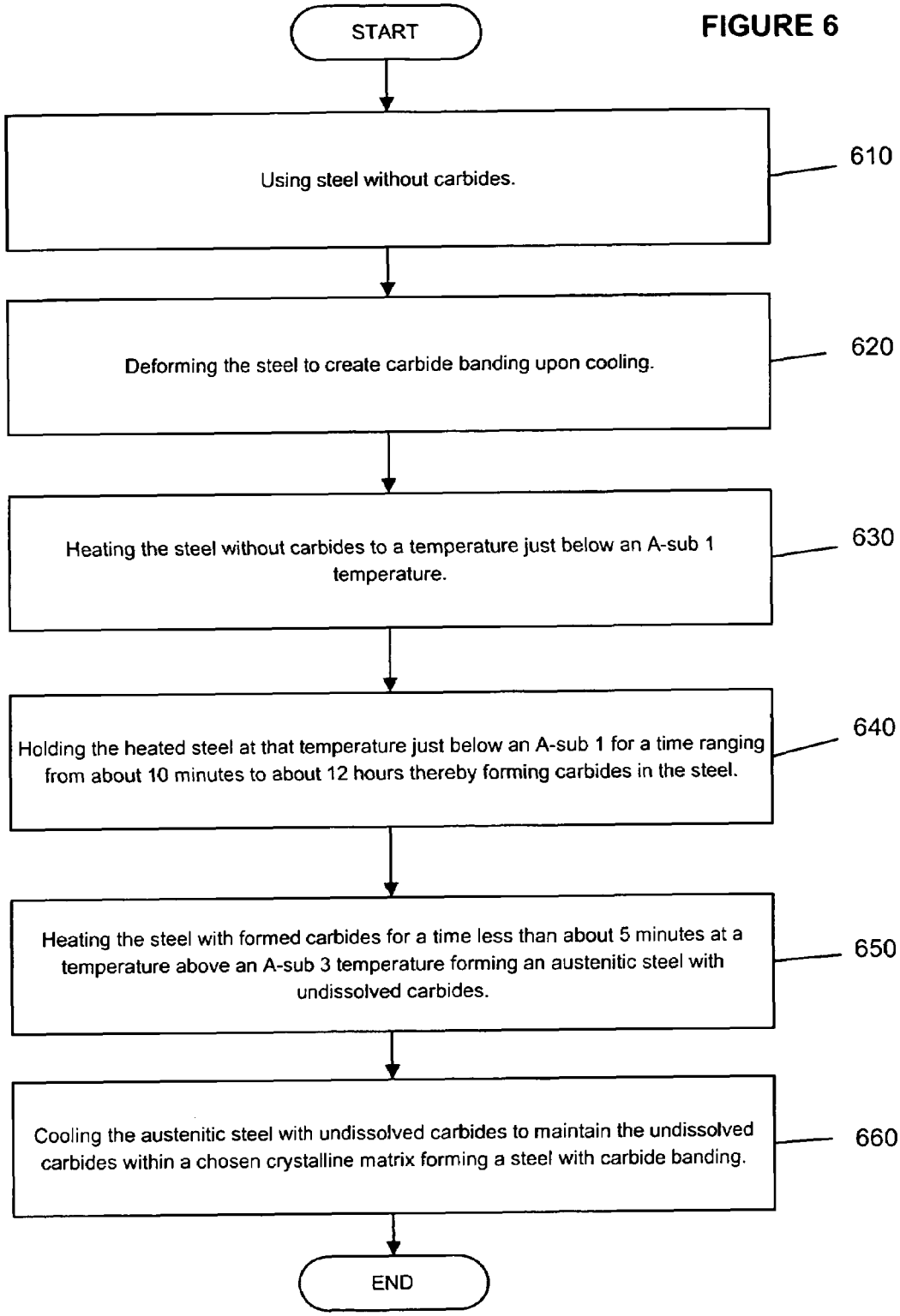
FIG. 6 is a schematic of an alternative embodiment of the method.

FIG. 6 depicts another alternative embodiment for a method of making steel with carbide banding. The method starts by using steel without carbides (610) and the subjecting the steel to deformation processes to create carbide banding (620).

The method continues by forming carbides in the steel. The carbides are formed by heating the steel without carbides to a temperature just below an A-sub 1 temperature (630) and then holding the heated steel at that temperature just below an A-sub 1 for a time ranging from about 10 minutes to about 12 hours thereby forming carbides in the steel (640).

Continuing with FIG. 6, the method continues by heating the steel with formed carbides for a time less than about 5 minutes at a temperature above an A-sub 3 temperature forming austenitic steel with undissolved carbides (650). The A-sub 3 temperature can range from about 1375 degrees Fahrenheit to about 2100 degrees Fahrenheit. The method ends by cooling the austenitic steel with undissolved carbides to maintain the undissolved carbides within a chosen crystalline matrix forming a steel with carbide banding The methods contemplate that the materials can be varied. Examples of crystalline matrix usable with the methods are pearlite, austenite, ferrite, martensite, tempered martensite, bainite, or combinations thereof. The steel with undissolved carbides can be stainless steel, carbon steel, tool steel, or a steel alloy.

The step of cooling the austenitic steel with undissolved carbides is by air cooling or quenching. The quenching process can be done by oil quenching, water quenching, salt quenching, air quenching, or combinations thereof.

In the alternative, the cooling step in the method can take place slowly at a temperature from just above 1330 degrees Fahrenheit to create a pearlite and ferrite crystalline matrix. The cooling time for this alternative can be from about 5 minutes to about 6 hours.

The deformation step in the methods can be completed by hot forging, cold forging, warm forging, bending, hot rolling, cold rolling, extruding, drop forging, twisting, pressing, or combinations thereof.

While these embodiments have been described with emphasis on the embodiments, it should be understood that within the scope of the appended claims, the embodiments might be practiced other than as specifically described herein.

What is claimed is:

1. A method of making steel with carbide banding comprising the steps of:

a. obtaining steel with undissolved carbides distributed within the steel for forming steel with carbide banding, wherein the steel comprises:
   i. from about 0.3 weight percent to about 2.2 weight percent carbon; and
   ii. at least about 0.003 weight percent of a metal selected from the group consisting of chromium, molybdenum, aluminum, vanadium, or tungsten;
b. deforming the steel with undissolved carbides to create steel with carbide banding upon cooling;
c. heating the steel with undissolved carbides for a time ranging from about 5 minutes to about 12 hours at a temperature above an A-sub 1 temperature to form an austenitic steel with undissolved carbides; and
d. cooling the austenitic steel with undissolved carbides to maintain the undissolved carbides within a crystalline matrix forming steel with carbide banding.

2. The method of claim 1, wherein the step of heating the steel with undissolved carbides occurs at a time ranging from about 20 minutes to about 40 minutes.

3. The method of claim 1, wherein the step of heating the steel is performed above the A-sub 1 temperature of at least 1330 degrees Fahrenheit.

4. The method of claim 1, wherein the step of the cooling the austenitic steel with undissolved carbides occurs at a time ranging from about 1 second to about 3 hours.

5. The method of claim 1, wherein the step of cooling the austenitic steel with undissolved carbides is performed slowly starting at a cooling temperature from about 1330 degrees Fahrenheit to create a pearlite and ferrite crystalline matrix.

6. The method of claim 5, wherein the step of cooling the austenitic steel occurs at a time ranging from about 5 minutes to about 6 hours.

7. The method of claim 1, wherein the steel with undissolved carbides is a member selected from the group consisting of a stainless steel, a carbon steel, a tool steel, and a steel alloy.

8. The method of claim 1, wherein the step of deforming the steel with undissolved carbides is by hot forging, cold forging, warm forging, bending, hot rolling, cold rolling, extruding, drop forging, twisting, pressing or combinations thereof.

9. The method of claim 1, wherein the step of cooling the austenitic steel with undissolved carbides is by air cooling or quenching.

10. The method of claim 9, wherein the quenching is by a member of the group selected from oil quenching, water quenching, salt quenching, air quenching, and combinations thereof.

11. The method of claim 1, wherein the crystalline matrix consists of pearlite, austenite, ferrite, martensite, tempered martensite, bainite, and combinations thereof.

12. A method of making steel with carbide banding, comprising the steps of:

a. obtaining steel without dissolved carbides, wherein the steel comprises:
   i. from about 0.3 weight percent to about 2.2 weight percent carbon; and
   ii. at least about 0.003 weight percent of a metal selected from the group consisting of chromium, molybdenum, aluminum, vanadium, or tungsten;
b. forming carbides in the steel by heating the steel without dissolved carbides at a temperature in the range from about an A-sub 1 temperature to about 50 degrees Fahrenheit below an A-sub 3 temperature for a time ranging from 10 minutes to 12 hours to form an austenitic steel with undissolved carbides;
c. deforming the austenitic steel with undissolved carbides; and
d. cooling the austenitic steel to precipitate carbides within a crystalline matrix forming a steel with carbide banding.

13. The method of claim 12, wherein the heating is performed at about 50 degrees below an A-sub 3 temperature, wherein the A-sub 3 temperature ranging from about 1375 degrees Fahrenheit to about 2100 degrees Fahrenheit.

14. The method of claim 12, wherein the heating is performed at the A-sub 1 temperature of at least 1330 degrees Fahrenheit.

15. The method of claim 12, wherein the heating of the steel with undissolved carbides occurs at a time ranging from about 20 minutes to about 40 minutes.

16. The method of claim 12, wherein the step of the cooling the austenitic steel with undissolved carbides occurs at a time ranging from about 1 second to about 3 hours.

17. The method of claim 12, wherein the step of cooling the austenitic steel with undissolved carbides is performed slowly starting at a cooling temperature from about 1330 degrees Fahrenheit to create a pearlite and ferrite crystalline matrix.

18. The method of claim 17, wherein the step of cooling the austenitic steel occurs at a time ranging from about 5 minutes to about 6 hours.

19. A method of making steel with carbide banding, comprising the steps of:

a. obtaining steel without dissolved carbides, wherein the steel comprises:
   i. from about 0.3 weight percent to about 2.2 weight percent carbon; and
   ii. at least about 0.003 weight percent of a metal selected from the group consisting of chromium, molybdenum, aluminum, vanadium, or tungsten;
b. forming carbides in the steel by heating the steel without dissolved carbides at a temperature just below an A-sub 1 temperature to form an austenitic steel with undissolved carbides;
c. holding the heated austenitic steel with undissolved carbides at the temperature just below the A-sub 1 temperature for a time ranging from about 10 minutes to about 12 hours to form carbides in the steel;
d. deforming the steel with formed carbides; and
e. cooling the steel with formed carbides to precipitate the formed carbides within a crystalline matrix forming a steel with carbide banding.

20. A method of making steel with carbide banding, comprising the steps of:

a. obtaining steel without dissolved carbides, wherein the steel comprises:
   i. from about 0.3 weight percent to about 2.2 weight percent carbon; and
   ii. at least about 0.003 weight percent of a metal selected from the group consisting of chromium, molybdenum, aluminum, vanadium, or tungsten;
b. forming carbides in the steel by cyclically heating the steel without carbides at a temperature just above an A-sub 1 temperature and just below an A-sub 3 temperature to form an austenitic steel with undissolved carbides;
c. deforming the steel with formed carbides; and
d. cooling the steel with formed carbides to precipitate the formed carbides within a crystalline matrix forming a steel with carbide banding.

21. A method of making steel with carbide banding, comprising the steps of:

a. obtaining steel without carbides, wherein the steel comprises:
   i. from about 0.3 weight percent to about 2.2 weight percent carbon; and
   ii. at least about 0.003 weight percent of a metal selected from the group consisting of chromium, molybdenum, aluminum, vanadium, or tungsten;
b. deforming the steel to create carbide banding;
c. forming carbides in the steel, comprising the steps of:
   i. heating the steel without carbides to a temperature just below an A-sub 1 temperature; and ii. holding the heated steel at that temperature just below an A-sub 1 temperature for a time ranging from about 10 minutes to about 12 hours thereby forming carbides in the steel;

d. heating the steel with formed carbides for a time less than about 5 minutes at a temperature above an A-sub 3 temperature forming an austenitic steel with undissolved carbides; and e. cooling the austenitic steel with undissolved carbides to maintain the undissolved carbides within a chosen crystalline matrix forming a steel with carbide banding.

22. The method of claim 21, wherein the step of heating comprises using a temperature above an A-sub 3 temperature, wherein the A-sub 3 temperature ranges from about 1375 degrees Fahrenheit to about 2100 degrees Fahrenheit.

* * * * *